US009514722B1

(12) United States Patent
Kim et al.

(10) Patent No.: US 9,514,722 B1
(45) Date of Patent: Dec. 6, 2016

(54) AUTOMATIC DETECTION OF DENSE ORNAMENTATION IN MUSIC

(71) Applicant: Adobe Systems Incorporated, San Jose, CA (US)

(72) Inventors: Minje Kim, Savoy, IL (US); Gautham J. Mysore, San Francisco, CA (US); Paris Smaragdis, Urbana, IL (US); Peter Merrill, Sunnyvale, CA (US)

(73) Assignee: Adobe Systems Incorporated, San Jose, CA (US)

( * ) Notice: Subject to any disclaimer, the term of this patent is extended or adjusted under 35 U.S.C. 154(b) by 0 days.

(21) Appl. No.: 14/937,463

(22) Filed: Nov. 10, 2015

(51) Int. Cl.
*G04B 13/00* (2006.01)
*G10H 1/00* (2006.01)

(52) U.S. Cl.
CPC ..... *G10H 1/0008* (2013.01); *G10H 2210/061* (2013.01); *G10H 2210/071* (2013.01); *G10H 2250/055* (2013.01); *G10H 2250/135* (2013.01); *G10H 2250/215* (2013.01)

(58) Field of Classification Search
CPC ..... G06N 5/047; G06T 11/206; G06T 2207/20081; G06T 7/0014; G06T 2207/10024
See application file for complete search history.

(56) References Cited

PUBLICATIONS

Juan P. Bello et al., "On the Use of Phase and Energy for Musical Onset Detection in the Complex Domain", IEEE Signal Processing Letters, Jun. 2004, pp. 553-556, vol. 11, No. 6.

Judith C. Brown, "Calculation of a Constant Q Spectral Transform", J. Acoustical Society of America, Jan. 1991, pp. 425-434, vol. 89, No. 1.

Derry Fitzgerald, "Harmonic/Percussive Separation Using Median Filtering", Procedure of the 13th Int. Conference on Digital Audio Effects, Sep. 6-10, 2010, pp. 1-4, DAFx-10, Graz, Austria.

Daniel P.W. Ellis, "Beat Tracking by Dynamic Programming", Jul. 16, 2007, pp. 1-21, LabROSA, Columbia University, New York.

A.P. Klapuri et al., "Analysis of the Meter of Acoustic Musical Signals", IEEE Trans. Speech and Audio Proc., 2004, pp. 1-15.

Karthik Yadati et al., "Detecting Drops in Electronic Dance Music: Content Based Approaches to a Socially Significant Music Event", 15th International Society for Music Information Retrieval Conference, 2014, pp. 143-148.

*Primary Examiner* — Marlon Fletcher
(74) *Attorney, Agent, or Firm* — Finch & Maloney PLLC

(57) ABSTRACT

Techniques are disclosed for automatic detection of dense ornamentation in music. Input data representing a piece of digitally encoded music in a time domain is converted into a spectrogram representing time-frequency coefficients in a frequency domain. The spectrogram includes column vectors of the time-frequency coefficients that correspond to time periods spanning different portions of the piece of music. A one-dimensional onset detection array is calculated based on a subset of the column vectors. Using the spectrogram and the onset detection array, a two-dimensional self-similarity matrix (SSM) is calculated based on pair-wise comparisons of elements in the onset detection array. As a result, an irregular pattern score representing the presence of dense ornamentation in the piece of music can be calculated based on a magnitude difference between a beat pattern in the music and each column of the slim SSM.

20 Claims, 8 Drawing Sheets
(4 of 8 Drawing Sheet(s) Filed in Color)

AUTOMATIC DETECTION OF DENSE ORNAMENTATION IN MUSIC

FIELD OF THE DISCLOSURE

This disclosure relates generally to the field of digital audio signal processing, and more particularly, to techniques for automatic detection of dense ornamentation in music.

BACKGROUND

Detecting changes in the pitch, rhythm, or other dynamics of music is useful for audio analysis applications. For example, when creating a photo slide show set to music, the viewer's multimedia experience can be enhanced by automatically synchronizing the visual effects of the slide show to the salient parts of the music. The viewing experience can be further enhanced when the multimedia is synchronized to dense ornamentation in the music, such as a rapid succession of drum beats over a relatively short period of time, or a mid-song guitar or base solo, or an introductory flute or piano solo, or other localized irregular parts of musical content that can be distinguished from an overall repetitive global structure of that musical content. Such localized irregular portions tend to provide a memorable or otherwise aurally dense and distinguishable part of the music, and are generally referred to in this disclosure as dense ornamentation. Such dense ornamentation, whether it is a single event such as the banging of a gong or a series of events such as a drum solo, may manifest itself as a localized pattern in the corresponding audio signal. However, some existing algorithms that are designed to synchronize multimedia to the playback of music don't identify, respond to, or otherwise exploit such localized dense ornamentation features to enhance the multimedia experience. Rather, such existing algorithms are generally configured to focus on global components of the music.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The accompanying drawings are not intended to be drawn to scale. In the drawings, each identical or nearly identical component that is illustrated in various figures is represented by a like numeral.

DETAILED DESCRIPTION

Figure 1:
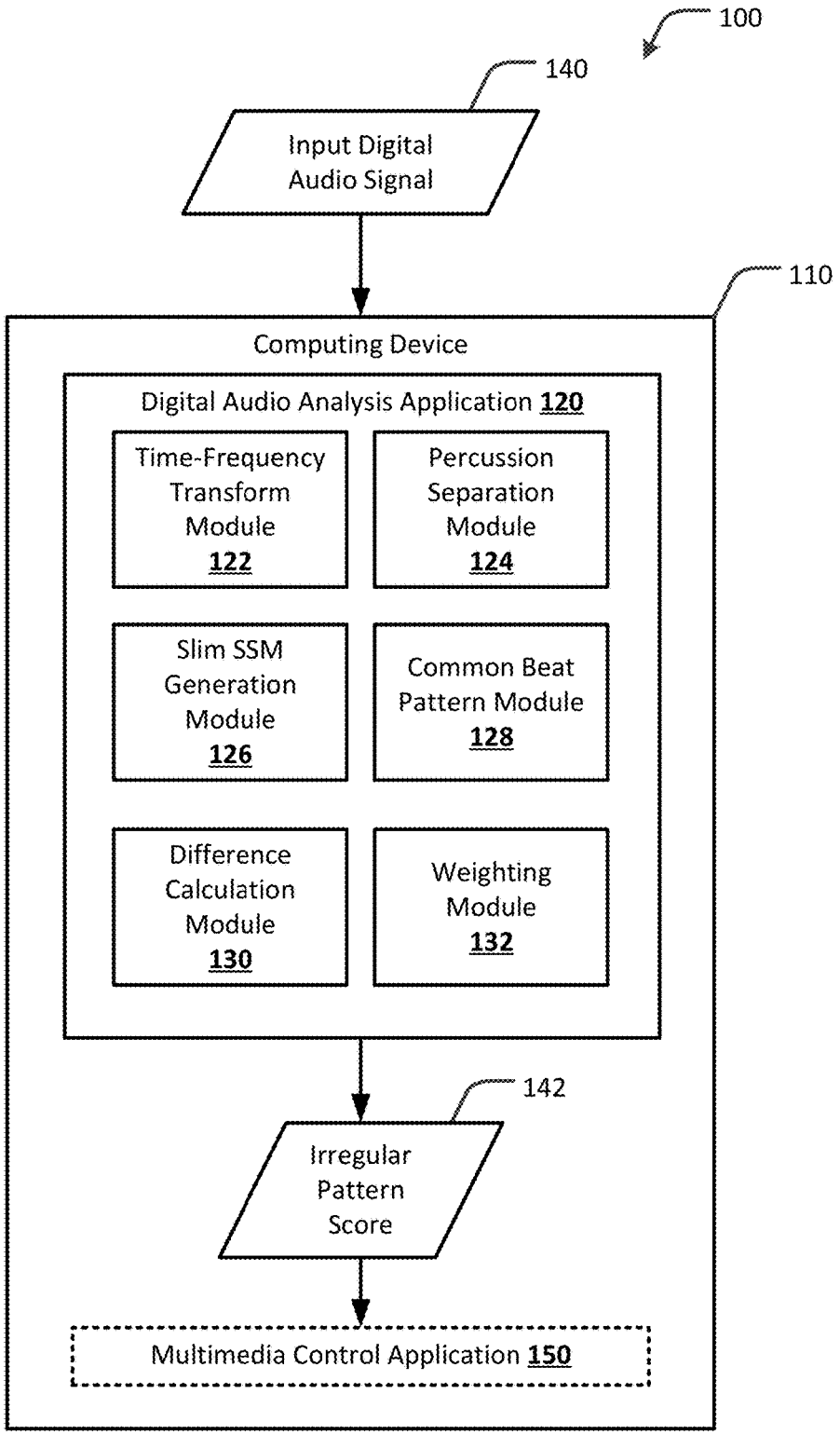
FIG. 1 shows an example digital image editing system, in accordance with an embodiment of the present disclosure.

Music visualization generally includes generating animated imagery and other visual effects based on the dynamics of a piece of music. For instance, beat tracking, which is a technique for deriving a beat pattern from an audio signal, can be used to generate visual effects that are timed to coincide with events in the music. Some existing digital audio signal processing techniques can reveal musical patterns in a song by detecting similarities and differences within temporal segments of an audio signal using a self-similarity matrix (SSM). An SSM represents a comparison, spatial distance or correlation between features (e.g., spectral properties) in the audio signal, and can be used to identify similar sequences occurring at different portions of the signal. In an SSM, the (i, j)-th element of the matrix represents the similarity between two events in the signal starting from i-th and j-th frames of the signal, which can serve as the basis for visualization. However, some of these techniques suffer from a number of shortcomings. For instance, beat tracking tasks that focus more on the global beat pattern rather than local variations will normally identify only drum attacks that are near the beat periods while ignoring all the other attacks within the beat period. In this manner, the dense drum attacks are likely to interfere with beat tracking. In addition, and with respect to using an SSM to reveal musical patterns, note that high temporal resolution in the SSM is needed to account for the frequently varying temporal nature of dense ornamentation in music. While a high resolution SSM can be obtained by reducing the hop size during the time-frequency transformation, this also increases the size of the SSM. As such, processing the data in the high resolution SSM becomes computationally expensive, particularly on mobile devices such as smartphones and tablets that may have less processing horsepower than desktop and laptop computers and are constrained with respect to power consumption (e.g., computationally expensive tasks wear down battery power faster than less computationally expensive tasks).

To this end, and in accordance with an embodiment of the present disclosure, techniques are disclosed for automatic detection of irregular patterns in music, which can indicate the presence of dense ornamentation. Once such dense ornamentation is identified, a corresponding multimedia experience can be enhanced accordingly. For instance, a localized drum solo or other detectable localized musical event within a given piece of music can be accompanied by imagery and/or lighting that changes in unison or otherwise complements the playback of the music. The techniques recognize that a full self-similarity matrix (SSM) is not needed to identify events that have finer temporal structures typical of dense ornamentation. Instead, it is sufficient to watch only elements near the diagonal of the matrix, because that is where beat patterns are encoded. As a result, the slim band of near-diagonal elements can be used without calculating the off-diagonal elements, in accordance with some embodiments. This reduced-processing SSM is referred to herein as a slim SSM. Note that by ignoring off-diagonal elements, the similarity information between events that are relatively far apart or less dense (such global events that repeat throughout the musical piece or other non-dense ornamentation) may be lost. However, if a multimedia response to such global events is desired as well, then a full SSM can be constructed in addition to the slim SSM, but using a lower temporal resolution for the full SSM that captures the global similarity structure. In this way, a lower resolution full SSM can be used to supplement a higher resolution slim SSM. Thus, the techniques can be used to identify both local patterns containing so-called dense ornamentation as well as global patterns, so each type of identified pattern within a given musical piece can be accompanied with an appropriate multimedia response. As will be appreciated in light of this disclosure, the multimedia response can vary from embodiment to the next and the present disclosure is not intended to be limited to any particular type of multimedia response.

In operation, and according to an embodiment, input data representing a piece of digitally encoded music in a time domain is converted into a spectrogram representing a two-dimensional matrix of time-frequency coefficients in a frequency domain. The spectrogram includes column vectors of the time-frequency coefficients that correspond to time periods spanning different portions of the piece of music. A one-dimensional onset detection array, from which the onset of a percussive event or other dense ornamentation in the music can be detected, is then calculated based on a subset of the column vectors in the spectrogram. Next, a two-dimensional self-similarity matrix (SSM) is calculated based on pair-wise comparisons of elements in the onset detection array. The self-similarity matrix may be a slim SSM, which has fewer elements than a full, or square, SSM that includes pair-wise comparisons of all possible combinations of all of the time-frequency coefficients. By using the slim SSM rather than the full SSM, the processing workload for detecting dense ornamentation in the music can be reduced based on the observation that not all elements in the full SSM are needed to identify events in the music that have finer temporal structures. Instead, and as previously explained, it is sufficient to observe the elements near the diagonal of the full SSM matrix, because most of the dense ornamentation beat patterns are relatively close to one another. Thus, only the slim band of elements near the diagonal of the full SSM is utilized, without calculating the relatively distant off-diagonal elements. As a result, an irregular pattern score representing the presence of dense ornamentation in the piece of music can be calculated based on a magnitude difference between a beat pattern in the music and each column of the slim SSM. Accordingly, the disclosed techniques are faster and utilize fewer computing resources than prior techniques. Furthermore, the disclosed techniques are generalized for detecting any type of event in the audio signal, and are universally applicable to any genre of music. Numerous configurations and variations will be apparent in light of this disclosure.

Example System

FIG. 1 shows an example system 100 for automatic detection of dense ornamentation in music, in accordance with an embodiment of the present disclosure. The system 100 includes a computing device 110 configured to execute a digital audio analysis application 120. The application 120 receives as an input a digital audio signal 140 representing a piece of music, and provides as an output an irregular pattern score 142, which can be used to determine the presence of dense ornamentation in the piece of music. The application 120 may include one or more modules, each configured to perform one or more functions. For example, the application 120 may include a time-frequency transform module 122, a percussion separation module 124, a slim SSM generation module 126, a common beat pattern module 128, a difference calculation module 130, a weighting module 132, or any combination of these modules. The functionality of the application 120 will be described in greater detail with respect to FIGS. 2-6. In some embodiments, the computing device 110 is further configured to execute a multimedia control application 150. The multimedia control application 150 is configured to receive the input digital audio signal 140 and the irregular pattern score 142, and to generate or enhance a visualization of the input digital audio signal 140 (e.g., a photo slide show) or other multimedia (e.g., a display or lighting output) based on the irregular pattern score 142.

Example Data Flow and Methodology

Figure 2:
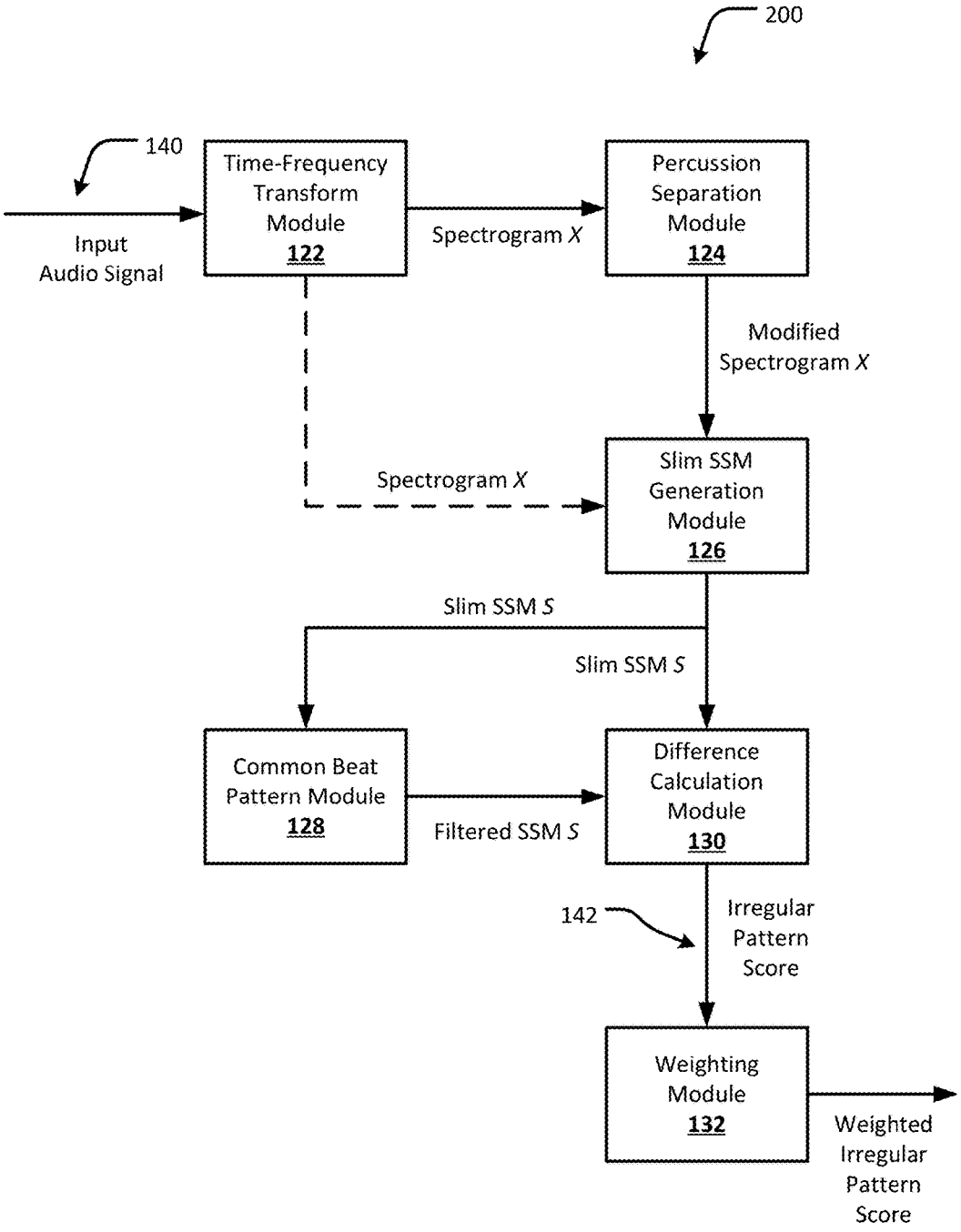
FIG. 2 is a flow diagram of an example data flow for use with a methodology for detection of irregular patterns typical of dense ornamentation in music, in accordance with an embodiment of the present disclosure.

FIG. 2 is a flow diagram of an example data flow 200 for use with a methodology for detection of dense ornamentation in music, in accordance with an embodiment of the present disclosure. The methodology 200 may, for example, be implemented in the system 100 of FIG. 1. Initially, the input audio signal 140, which represents a one-dimensional, temporally segmented piece of digital music, is received by the time-frequency transform module 122. The time-frequency transform module 122 is configured to convert the input audio signal 140 into a two-dimensional matrix, or spectrogram, using a time-frequency transform. In some embodiments, the time-frequency transform can be a Fourier transform or a Constant-Q Transform (CQT), which is tailored for analyzing music. However, it will be understood that other types of transforms can be used without departing from the scope of the present disclosure. Using the time-frequency transform, the time-frequency transform module 122 converts temporal segments of the input audio signal 140, also referred to as frames, into coefficients in the frequency domain. The coefficients represent the contribution of the frequency bands in each frame of the input audio signal 140. Although the time-frequency transforms can produce complex-valued coefficients, it is possible in some embodiments for the coefficients in the spectrogram to include only the magnitudes. Each time-frequency conversion results in a column vector of frequency coefficients in the spectrogram. Conversion of all frames from the start to the end of the audio signal produces a sequence of such column vectors. A high temporal resolution can be achieved in the conversion by using short time segments (short hop size), which in turn increases the number of column vectors (spectra) in the spectrogram. In FIG. 2, the resulting matrix of time-frequency coefficients produced by the time-frequency transform module 122 is labeled Spectrogram X.

Rhythmic sources in the audio signal can be separated from other harmonics or the harmonics can be suppressed to improve detection and tracking of percussive instruments in the music or any other instruments that are used to create a dense ornamentation within a given piece of music, although it will be understood that such processing is not necessary in certain embodiments. The percussion separation module 124 is configured to separate rhythmic sources from other harmonics in the audio signal by calculating the differences between the adjacent column vectors in the spectrogram to produce a modified Spectrogram X. Alternatively or additionally, the percussion separation module 124 is configured to suppress harmonic sources (e.g., voice, flute, or piano) in the audio signal by applying a median filter along the vertical axis of the spectrogram. This is possible because often the harmonic peaks are far from the median of vertically adjacent coefficients in the spectrogram. In some other embodiments, the spectrogram is not modified by the percussion separation module 124.

The slim SSM generation module 126 is configured to generate a slim self-similarity matrix using either the modified or the unmodified spectrogram. The slim SSM can be calculated from two different types of representation: the spectrogram and an onset function. The spectrogram (e.g., Spectrogram X) can include any time-frequency representation of the audio signal (e.g., frequency domain representations of the audio signal resulting Fourier or Constant-Q transforms of the time domain audio signal). The slim SSM represents the similarity (or difference) between two different frames of the audio signal as a function of a distance between onset events in the respective frames. An element of an example distance matrix D can be defined as follows:

$$D_{j-i,i} = \sum_{f=1}^{F} \sum_{g=0}^{G-1} \mathcal{D}(X_{f,i+g} \parallel X_{f,j+g}) \tag{1}$$

if $0<j-i\leq B$, where F is the number of frequency bands in the audio signal, G is the number of frames in the audio signal to compare (also referred to as a context window), and B denotes the positive number of adjacent events in the frame to compare.

An onset envelope function can be extracted from a time-frequency representation of the signal, such as Spectrogram X described above. The onset envelope function represents the frame-by-frame differences of the input audio signal 140, and can be used to identify an onset event, which is the beginning of a change in some characteristic of the audio signal 140. In some cases, columns of data in the spectrogram can be summed up to construct the one-dimensional onset envelope function, which may, for example, reduce the amount of data processing performed by the slim SSM generation module 126 or other components of the system 100. A candidate onset event occurs when a frequency spectrum of one frame of the input audio signal 140 is significantly different from the frequency spectrum of a prior frame (e.g., the immediately preceding frame or an earlier frame). The differences between the spectra may, for example, be caused by an impulsive attack of a percussive instrument or an abrupt change of harmonics in the signal. Therefore, the sum of differences between two adjacent spectra can be used to define an activation envelope of an onset event. Equation (1) can be reduced using an example onset function:

$$o_t = \sum_{f=1}^{F} X_{f,t} \tag{2}$$

to arrive at:

$$D_{j-i,i} = \sum_{g=0}^{G-1} \mathcal{D}(o_{i+g} \parallel o_{j+g}) \tag{3}$$

if $0<j-i\leq B$. In this manner, the sum over the frequency bands f in equation (1) can be avoided.

Figure 3:
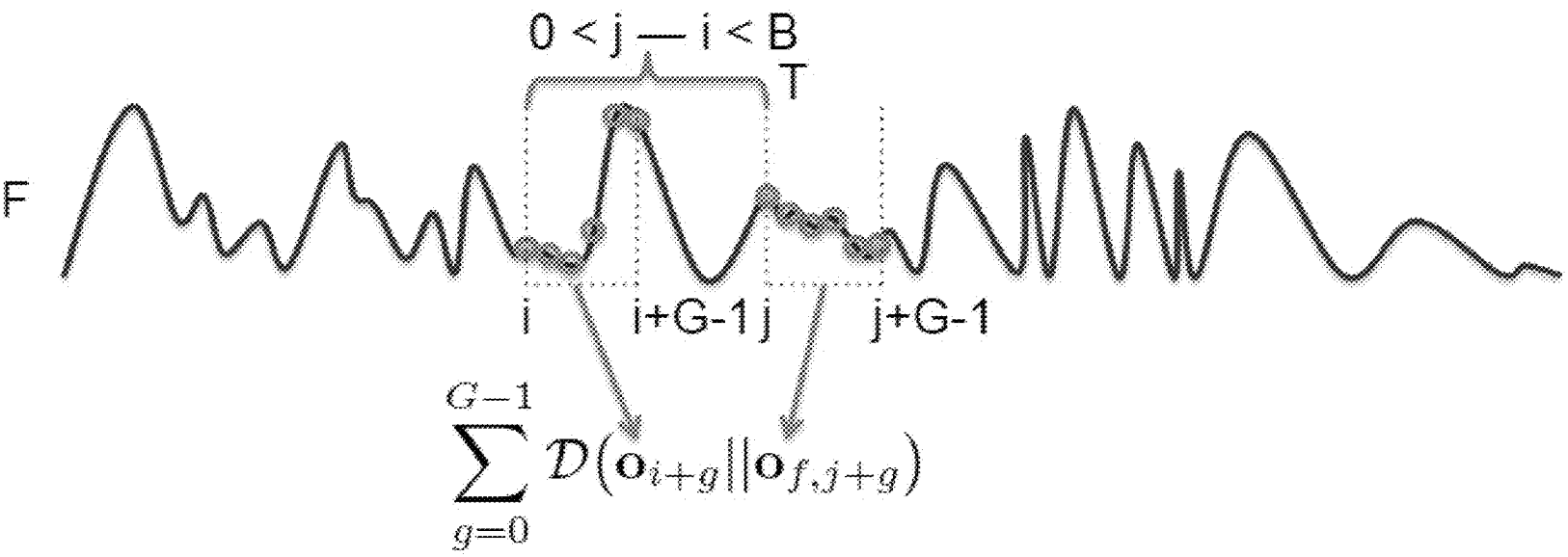
FIG. 3 shows an example onset envelope function, in accordance with an embodiment of the present disclosure.
Figure 4A:
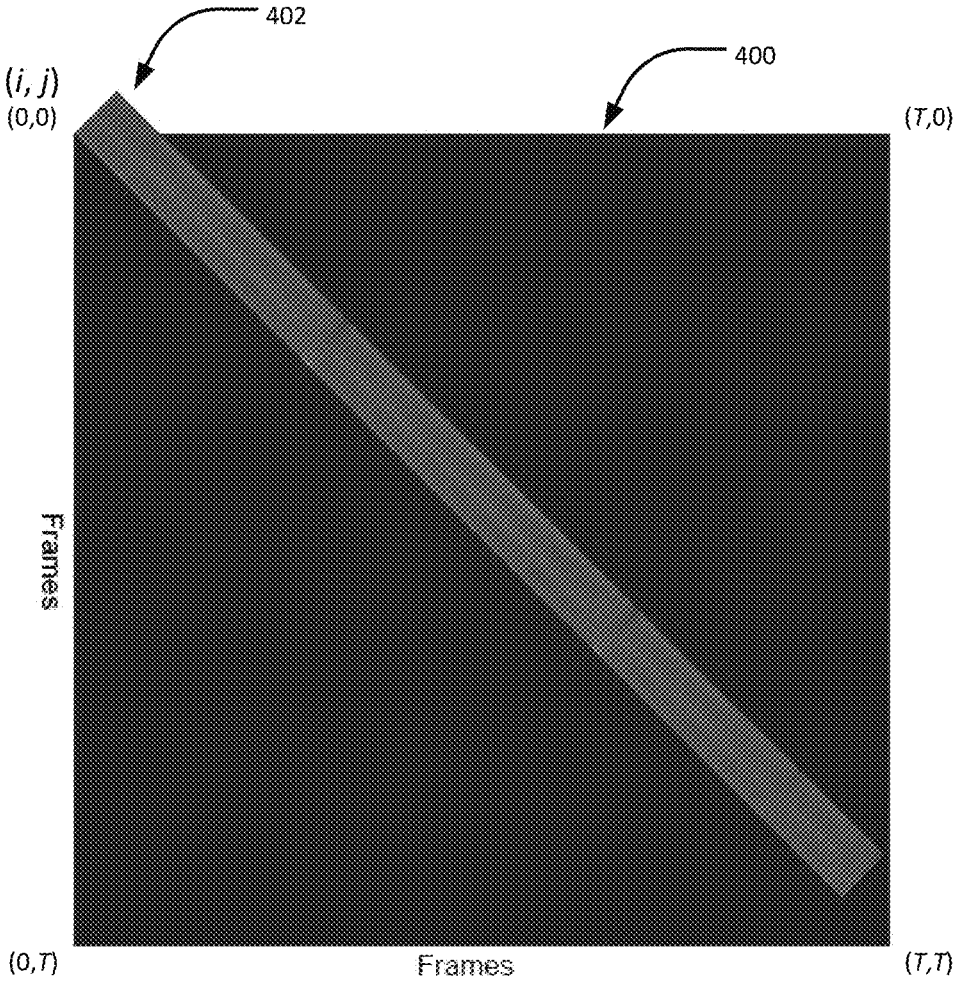
FIG. 4A illustrates an example square self-similarity matrix (SSM) and an example slim SSM, both of which can be used to identify patterns in music, in accordance with an embodiment of the present disclosure.
Figure 4B:
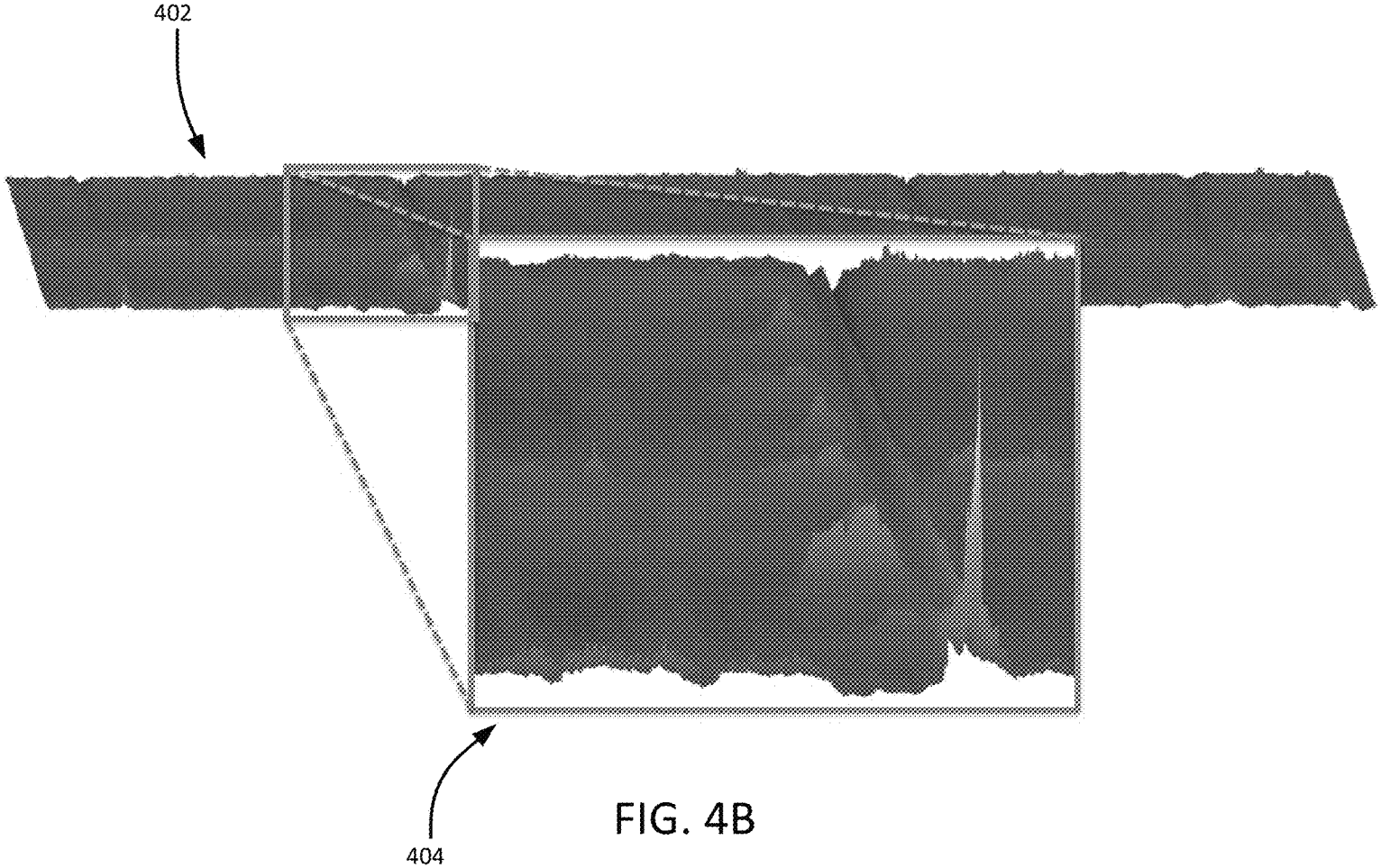
FIG. 4B shows the example slim SSM of FIG. 4A in more detail, according to one such embodiment.

FIG. 3 shows an example onset envelope function F and its relation to the function D in equation (3), in accordance with an embodiment of the present disclosure. FIG. 4A illustrates an example square self-similarity matrix 400, with an example slim SSM 402, which can be derived from the square SSM 400, superimposed over the square SSM 400, in accordance with an embodiment of the present disclosure. FIG. 4B shows the example slim SSM 402 in more detail and from a perspective viewpoint. In equation (3), the distance matrix D is not symmetric (e.g., D is not a T×T matrix), but rather a B×(T−G+1) fat matrix, where the height B is less than the total number of frames T in the input audio signal, as can be seen in FIGS. 4A and 4B. The context window G is useful when the length of an onset event is longer than one frame (e.g., two or more seconds if one frame is approximately one second long), so that each element in the slim SSM represents the distance between two onset events starting at i-th frame and j-th frame, respectively (e.g., where frames i and j are not adjacent).

In one example, the resulting slim SSM S has the temporal beat patterns as shown in FIG. 4B. In FIG. 4B, there is a globally common beat pattern 402, which is represented as two horizontally lined-up peaks. But, in the close-up region 404, eight additional peaks are shown, which imply that there is a more dense beat structure in that area.

The function $\mathcal{D}$ in equation (3) can be any distance metric, such as a cosine or a Euclidean distance. Therefore, matrix D is a pairwise distance matrix. An element-wise inversion function can be used to convert matrix D into a similarity matrix S, for example:

$$S_{i,j} = \frac{1}{D_{[i,j]}+\epsilon}$$

where $\epsilon$ is a very small constant.

In some embodiments, the diagonal elements of matrix D provide no meaningful information, and therefore no inversion is necessarily needed for elements where i=j.

Referring again to FIG. 2, for a given slim SSM S, the common beat pattern module 128 is configured to identify a common beat pattern by applying a median filter to S along the horizontal (time) axis to produce a filtered SSM S, for example:

$$\hat{s}_i = \text{median}(S_{i,:}) \tag{4}$$

where $S_{i,:}$ denotes a row vector of the similarity matrix S.

The difference calculation module 130 is configured to compute an irregularity score 142 from the difference between the median-filtered beat pattern $s_{ti}$ and every column in the slim SSM S, for a given distance function $\mathcal{D}$, for example:

$$y_j = \sum_i \mathcal{D}(S_{i,j} \parallel \hat{s}_i)$$

Figure 5:
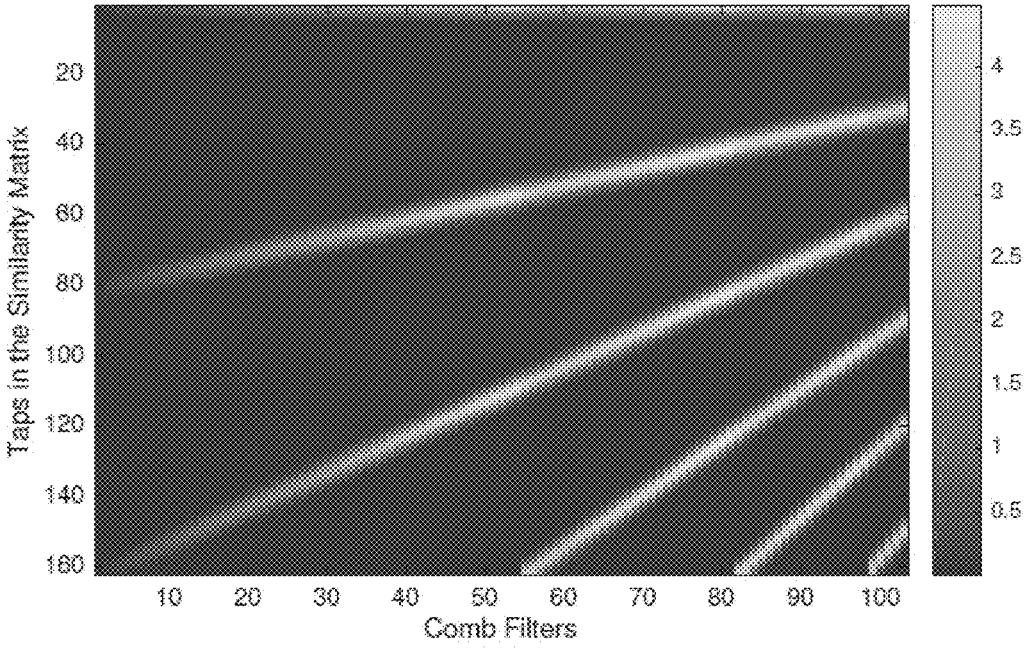
FIG. 5 shows an example comb filter that can be used to isolate or identify a period of dense ornamentation in music, in accordance with an embodiment of the present disclosure.

In some embodiments, the weighting module 132 is configured to apply a weight to the irregularity score y during post-processing. For example, the weight can provide emphasis to louder regions of the input audio signal by calculating a weighting vector as a function of the sums of the spectrogram along the frequency axis, such as:

$$v_j = \sum_i f(X_{i,j}) \tag{6}$$

where f( ) can be any additional transformation of the magnitudes of the spectrogram X, such a logarithmic transformation. In another example, more emphasis can be given to regions having more similarity peaks by applying comb filtering, with a higher emphasis on the comb filters with more peaks. FIG. 5 shows an example comb filter, C, in accordance with an embodiment of the present disclosure. Note that the similarity peaks are higher when they are closer to each other. When C is multiplied to the slim SSM S and the coefficients along the vertical axis are summed, a new weight vector z is obtained, which emphasizes the regions with a denser beat pattern, for example:

$$Z=C^{T} \quad S \tag{7}$$

$$z_j = \sum_i Z_{i,j} \tag{8}$$

In some embodiments, post-processing includes applying the weights to the irregularity score, such as follows:

$$\hat{y}_j = y_j v_j z_j \tag{9}$$

Example Methodology

Figure 6:
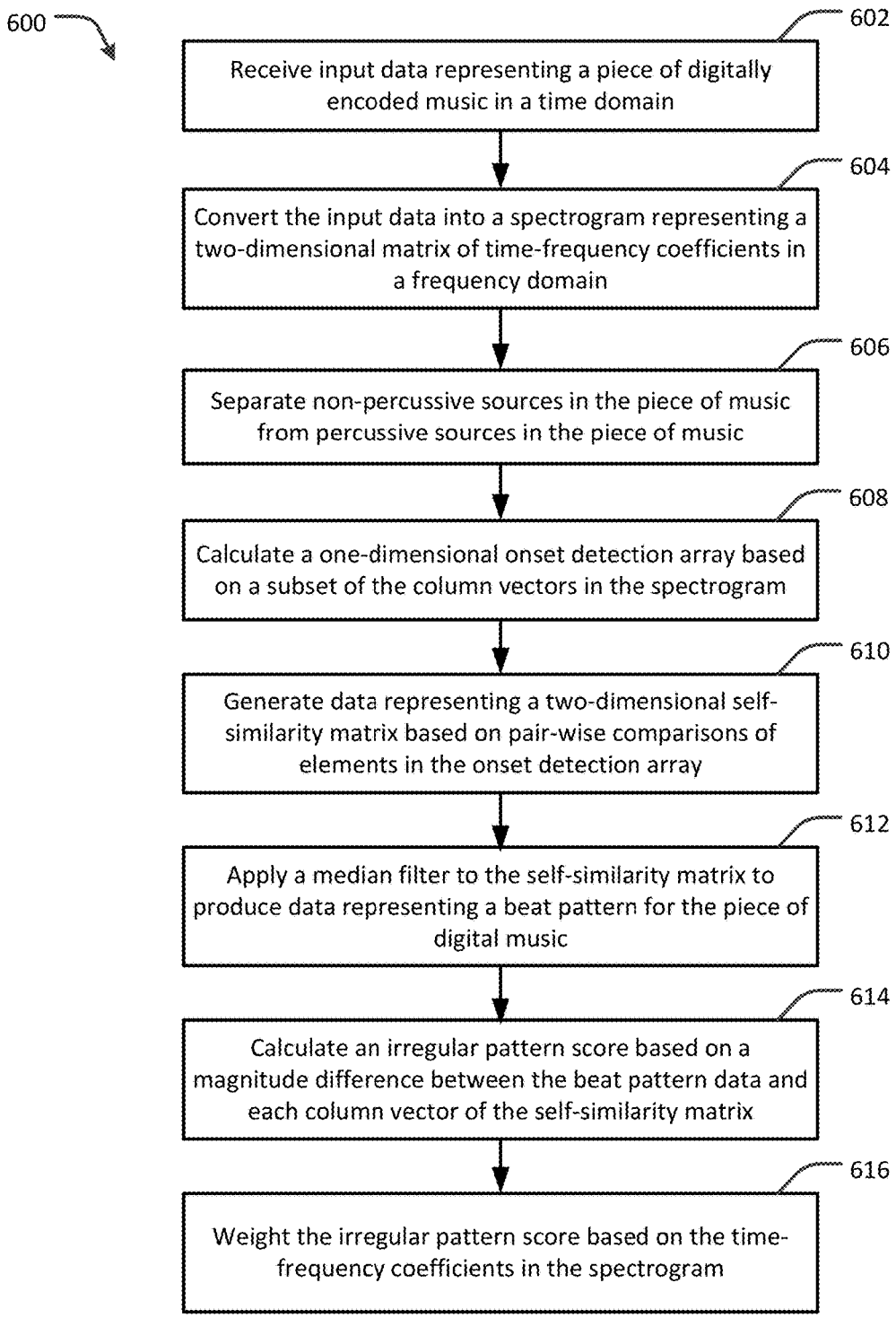
FIG. 6 is a flow diagram of example methodology for detection of dense ornamentation and other irregular patterns in digital music, in accordance with several embodiments of the present disclosure.

FIG. 6 is a flow diagram of a methodology 600 for detecting dense ornamentation in digital music, in accordance with several embodiments of the present disclosure. All or portions of the method 600 may, for example, be implemented in one or more of the modules 122, 124, 126, 128, 130, 132 in the computing device 110 of FIG. 1. The method 600 includes receiving 602 input data representing a piece of digitally encoded music in a time domain. The input data is converted 604 into a spectrogram representing a two-dimensional matrix of time-frequency coefficients in a frequency domain. Any suitable conversion technique may be used, such as a Fourier transform or a Constant-Q Transform (CQT). The spectrogram includes column vectors of the time-frequency coefficients that correspond to time periods spanning different portions of the piece of music.

In some embodiments, the method 600 includes separating 606 non-percussive sources in the piece of music from percussive sources in the piece of music by modifying at least one of the time-frequency coefficients in the spectrogram. For example, salient rhythmic patterns may be associated with the presence of percussive instruments in music. Therefore, some techniques that can boost up the drum part, or any percussive notes, may help improve the quality of tracking. For a given spectrogram X, one technique of boosting the rhythmic source in the music includes calculating the difference between adjacent columns. Another technique includes median filtering along the vertical axis of the spectrogram, which can quickly wipe out the harmonic peaks, since most of the time those peaks are far from the median of a given choice of vertically adjacent coefficients. Furthermore, columns of data in the processed spectrogram can be summed up to construct a one dimensional onset function to reduce the amount of the information being processed. In some embodiments, the separating occurs prior to generating self-similarity matrix data, such as described below.

Each of the time periods may, for example, be short relative to the overall time length of the piece of music, which in turn increases the number of column vectors (spectra) in the spectrogram. However, in some embodiments, it is not necessary to compare the spectra of distant time periods, since percussive events tend to be dense (many beats) and localized (occur during relatively short periods of the music). Thus, in some embodiments, the method 600 includes calculating 608 a one-dimensional onset detection array based on a subset of the column vectors in the spectrogram, where the subset of the column vectors in the spectrogram is fewer than all of the column vectors in the spectrogram. For example, the subset may include as few as two of the column vectors. In some embodiments, the calculating 608 of the onset detection array includes calculating, for each of the column vectors in the spectrogram, a sum of the time-frequency coefficients in the respective column vector, where the sums are the elements in the onset detection array.

The method 600 further includes generating 610 data representing a two-dimensional self-similarity matrix based on pair-wise comparisons of elements in the onset detection array, applying 612 a median filter to the self-similarity matrix to produce data representing a beat pattern for the piece of digital music, and calculating 614 an irregular pattern score based on a magnitude difference between the beat pattern data and each column of the self-similarity matrix, where the irregular pattern score represents a presence of dense ornamentation in the piece of music. For example, the higher the irregular pattern score, the greater the probability that a given portion of the piece of music includes dense ornamentation (e.g., a drum attack or other percussive event). The irregular pattern score may then be used, for example, by a multimedia generation tool to synchronize salient portions of the music to visual effects, such as transitions between images in a photo slide show. In some embodiments, the pair-wise comparisons of elements in the onset detection array are performed by calculating a distance between different elements in the onset detection array.

In some embodiments, the method 600 includes weighting 616 the irregular pattern score based on the time-frequency coefficients in the spectrogram to produce a weighted irregular pattern score. For example, to emphasize the louder regions of the music, a weighting vector can be computed by summing the spectrogram along the frequency axis using any additional transformation of the magnitudes, such as a logarithm. It is also possible to focus more on the regions with more similarity peaks by applying comb filtering, with a higher emphasis on the comb filters with more peaks.

In some embodiments, the method 600 includes 3 controlling a multimedia playback based on the irregular pattern score. The multimedia playback includes aural presentation of the digitally encoded music and visual presentation of at least one other feature, where the dense ornamentation indicated by the irregular pattern score causes a change in the visual presentation.

Example Computing Device

Figure 7:
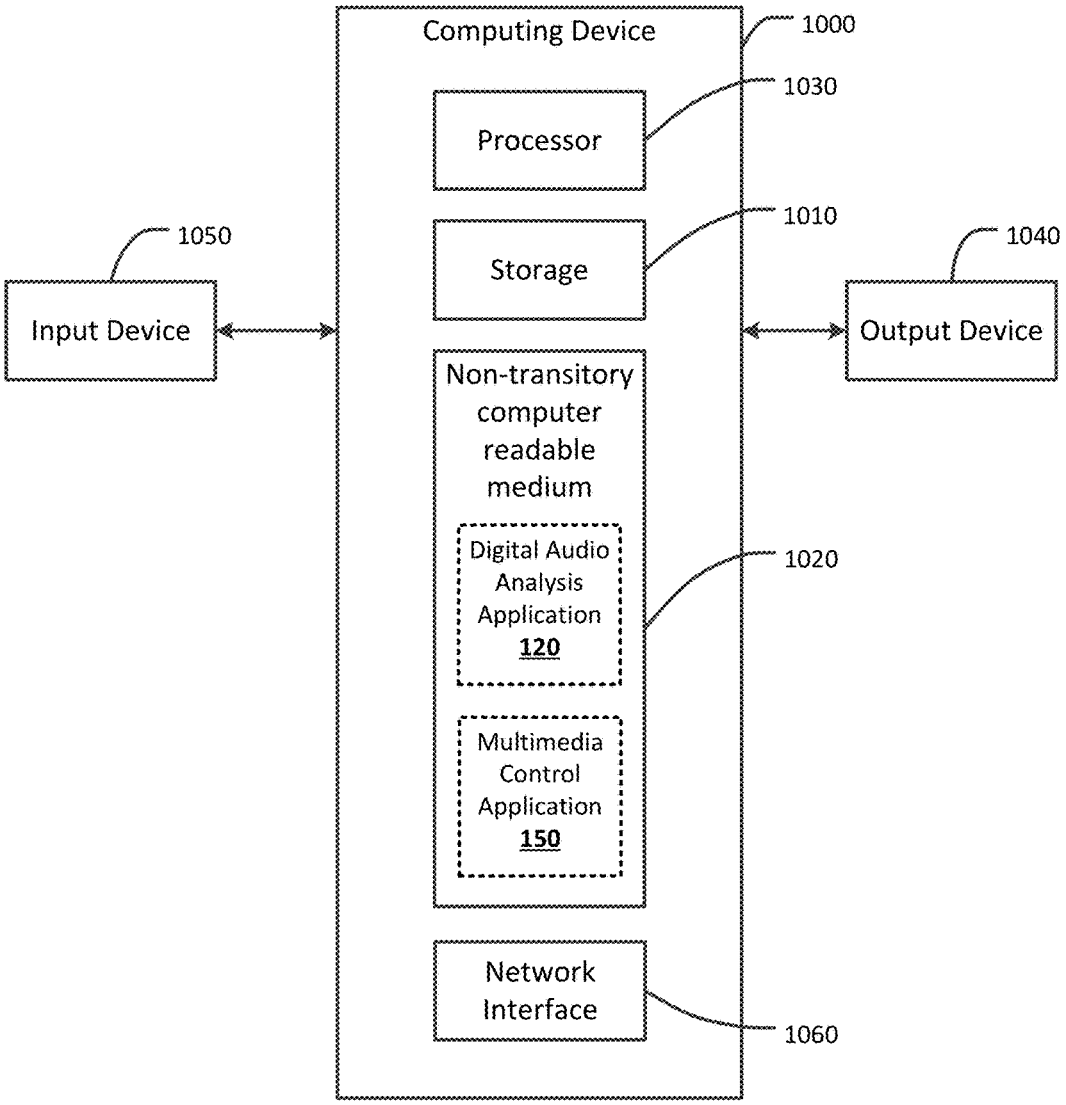
FIG. 7 is a block diagram representing an example computing device that may be used to perform any of the techniques as variously described in this disclosure.

FIG. 7 is a block diagram representing an example computing device 1000 that may be used to perform any of the techniques as variously described in this disclosure. For example, the system 100 of FIG. 1, or any portions thereof, and the methodologies of FIGS. 2 and 6, or any portions thereof, may be implemented in the computing device 1000. The computing device 1000 may be any computer system, such as a workstation, desktop computer, server, laptop, handheld computer, tablet computer (e.g., the iPad™ tablet computer), mobile computing or communication device (e.g., the iPhone™ mobile communication device, the Android™ mobile communication device, and the like), or other form of computing or telecommunications device that is capable of communication and that has sufficient processor power and memory capacity to perform the operations described in this disclosure. A distributed computational system may be provided comprising a plurality of such computing devices.

The computing device 1000 includes one or more storage devices 1010 and/or non-transitory computer-readable media 1020 having encoded thereon one or more computer-executable instructions or software for implementing techniques as variously described in this disclosure. The storage devices 1010 may include a computer system memory or random access memory, such as a durable disk storage (which may include any suitable optical or magnetic durable storage device, e.g., RAM, ROM, Flash, USB drive, or other semiconductor-based storage medium), a hard-drive, CD-ROM, or other computer readable media, for storing data and computer-readable instructions and/or software that implement various embodiments as taught in this disclosure. The storage device 1010 may include other types of memory as well, or combinations thereof. The storage device 1010 may be provided on the computing device 1000 or provided separately or remotely from the computing device 1000. The non-transitory computer-readable media 1020 may include, but are not limited to, one or more types of hardware memory, non-transitory tangible media (for example, one or more magnetic storage disks, one or more optical disks, one or more USB flash drives), and the like. The non-transitory computer-readable media 1020 included in the computing device 1000 may store computer-readable and computer-executable instructions or software for implementing various embodiments. The computer-readable media 1020 may be provided on the computing device 1000 or provided separately or remotely from the computing device 1000.

The computing device 1000 also includes at least one processor 1030 for executing computer-readable and computer-executable instructions or software stored in the storage device 1010 and/or non-transitory computer-readable media 1020 and other programs for controlling system hardware. Virtualization may be employed in the computing device 1000 so that infrastructure and resources in the computing device 1000 may be shared dynamically. For example, a virtual machine may be provided to handle a process running on multiple processors so that the process appears to be using only one computing resource rather than multiple computing resources. Multiple virtual machines may also be used with one processor.

A user may interact with the computing device 1000 through an output device 1040, such as a screen or monitor, which may display one or more user interfaces provided in accordance with some embodiments. The output device 1040 may also display other aspects, elements and/or information or data associated with some embodiments, such as a music visualization or photo slide show that is controlled by the multimedia control application 150 and coordinated with the dense ornamentation of the music as detected by the digital audio analysis application 120. In some cases, the output device 1040 may include a lighting controller configured to receive commands from the multimedia control application 150 for coordinating lighting effects and the dimming or switching of luminaires with the dense ornamentation of the music as detected by the digital audio analysis application 120. The computing device 1000 may include other I/O devices 1050 for receiving input from a user, for example, a keyboard, a joystick, a game controller, a pointing device (e.g., a mouse, a user's finger interfacing directly with a display device, etc.), or any suitable user interface. The computing device 1000 may include other suitable conventional I/O peripherals. The computing device 1000 can include and/or be operatively coupled to various suitable devices for performing one or more of the aspects as variously described in this disclosure.

The computing device 1000 may run any operating system, such as any of the versions of Microsoft® Windows® operating systems, the different releases of the Unix and Linux operating systems, any version of the MacOS® for Macintosh computers, any embedded operating system, any real-time operating system, any open source operating system, any proprietary operating system, any operating systems for mobile computing devices, or any other operating system capable of running on the computing device 1000 and performing the operations described in this disclosure. In an embodiment, the operating system may be run on one or more cloud machine instances.

In other embodiments, the functional components/modules may be implemented with hardware, such as gate level logic (e.g., FPGA) or a purpose-built semiconductor (e.g., ASIC). Still other embodiments may be implemented with a microcontroller having a number of input/output ports for receiving and outputting data, and a number of embedded routines for carrying out the functionality described in this disclosure. In a more general sense, any suitable combination of hardware, software, and firmware can be used, as will be apparent.

As will be appreciated in light of this disclosure, the various modules and components of the system, such as the digital audio analysis application 120, the time-frequency transform module 122, the percussion separation module 124, the slim SSM generation module 126, the common beat pattern module 128, the difference calculation module 130, the weighting module 132, the multimedia control application 150, or any combination of these, can be implemented in software, such as a set of instructions (e.g., HTML, XML, C, C++, object-oriented C, JavaScript, Java, BASIC, etc.) encoded on any computer readable medium or computer program product (e.g., hard drive, server, disc, or other suitable non-transient memory or set of memories, such as storage 1010), that when executed by one or more processors (e.g., processor 1030), cause the various methodologies provided in this disclosure to be carried out. It will be appreciated that, in some embodiments, various functions and data transformations performed by the user computing system, as described in this disclosure, can be performed by similar processors and/or databases in different configurations and arrangements, and that the depicted embodiments are not intended to be limiting. Various components of this example embodiment, including the computing device 1000, can be integrated into, for example, one or more desktop or laptop computers, workstations, tablets, smart phones, game consoles, set-top boxes, or other such computing devices. Other componentry and modules typical of a computing system, such as processors (e.g., central processing unit and co-processor, graphics processor, etc.), input devices (e.g., keyboard, mouse, touch pad, touch screen, etc.), and operating system, are not shown but will be readily apparent.

Numerous embodiments will be apparent in light of the present disclosure, and features described herein can be combined in any number of configurations. One example embodiment provides a method of detecting dense ornamentation in digital music. The method includes receiving, by a computer processor, input data representing a piece of digitally encoded music in a time domain; converting, by the computer processor, the input data into a spectrogram representing a two-dimensional matrix of time-frequency coefficients in a frequency domain using, for example, a time-frequency transform, the spectrogram including a plurality of column vectors of the time-frequency coefficients that correspond to a plurality of time periods spanning different portions of the piece of music; calculating, by the computer processor, a one-dimensional onset detection array based on at least one of the column vectors in the spectrogram; generating, by the computer processor, data representing a two-dimensional self-similarity matrix based on pair-wise comparisons of elements in the onset detection array; applying, by the computer processor, a median filter to the self-similarity matrix to produce data representing a beat pattern for the piece of digital music; and calculating, by the computer processor, an irregular pattern score based on a difference between the beat pattern data and the self-similarity matrix data, where the irregular pattern score represents a presence of dense ornamentation in the piece of music. In some cases, the method includes causing, by the computer processor, synchronization of a visual presentation with playback of the piece of music, wherein the irregular pattern score representing the presence of dense ornamentation causes a change in the visual presentation. In some cases, the calculating of the onset detection array includes calculating, for each of the column vectors in the spectrogram, a sum of the time-frequency coefficients in the respective column vector, where the sums are the elements in the onset detection array. In some cases, the pair-wise comparisons of elements in the onset detection array includes calculating a distance between different elements in the onset detection array. In some cases, the method includes separating, by the computer processor, non-percussive sources in the piece of music from percussive sources in the piece of music by modifying at least one of the time-frequency coefficients in the spectrogram. In some such cases, the separating occurs prior to the calculating of the one-dimensional onset detection array. In some cases, the method includes weighting, by the computer processor, the irregular pattern score based on the time-frequency coefficients in the spectrogram to produce a weighted irregular pattern score. In some cases, a number of columns of the self-similarity matrix is less than a number of rows of the self-similarity matrix.

Another example embodiment provides a system, in a digital medium environment for processing digital audio, for detection of dense ornamentation in music. The system includes a storage and a computer processor operatively coupled to the storage. The computer processor is configured to execute instructions stored in the storage that when executed cause the computer processor to carry out a process. The process includes receiving input data representing a piece of digitally encoded music in a time domain; converting the input data into a spectrogram representing a two-dimensional matrix of time-frequency coefficients in a frequency domain using, for example, a time-frequency transform, the spectrogram including a plurality of column vectors of the time-frequency coefficients that correspond to a plurality of time periods spanning different portions of the piece of music; calculating a one-dimensional onset detection array based on at least one of the column vectors in the spectrogram; generating data representing a two-dimensional self-similarity matrix based on pair-wise comparisons of elements in the onset detection array; applying a median filter to the self-similarity matrix to produce data representing a beat pattern for the piece of digital music; and calculating an irregular pattern score based on a difference between the beat pattern data and the self-similarity matrix data, where the irregular pattern score represents a presence of dense ornamentation in the piece of music. In some cases, the process includes causing synchronization of a visual presentation with playback of the piece of music, wherein the irregular pattern score representing the presence of dense ornamentation causes a change in the visual presentation. In some cases, the calculating of the onset detection array includes calculating, for each of the column vectors in the spectrogram, a sum of the time-frequency coefficients in the respective column vector, where the sums are the elements in the onset detection array. In some cases, the pair-wise comparisons of elements in the onset detection array includes calculating a distance between different elements in the onset detection array. In some cases, the process includes separating non-percussive sources in the piece of music from percussive sources in the piece of music by modifying at least one of the time-frequency coefficients in the spectrogram. In some such cases, the separating occurs prior to the calculating of the one-dimensional onset detection array. In some cases, the process includes weighting the irregular pattern score based on the time-frequency coefficients in the spectrogram to produce a weighted irregular pattern score. In some cases, a number of columns of the self-similarity matrix is less than a number of rows of the self-similarity matrix. Another example embodiment provides a non-transitory computer program product having instructions encoded thereon that when executed by one or more processors cause a process to be carried out for performing one or more of the aspects variously described in this paragraph or the methodology of the previous paragraph.

The foregoing description and drawings of various embodiments are presented by way of example only. These examples are not intended to be exhaustive or to limit the invention to the precise forms disclosed. Alterations, modifications, and variations will be apparent in light of this disclosure and are intended to be within the scope of the invention as set forth in the claims.

What is claimed is:

1. A method of detecting dense ornamentation in digital music, the method comprising:

receiving, by a computer processor, input data representing a piece of digitally encoded music in a time domain;

converting, by the computer processor, the input data into a spectrogram representing a two-dimensional matrix of time-frequency coefficients in a frequency domain, the spectrogram including a plurality of column vectors of the time-frequency coefficients that correspond to a plurality of time periods spanning different portions of the piece of music;

calculating, by the computer processor, a one-dimensional onset detection array based on at least one of the column vectors in the spectrogram;

generating, by the computer processor, data representing a two-dimensional self-similarity matrix based on pair-wise comparisons of elements in the onset detection array;

applying, by the computer processor, a median filter to the self-similarity matrix to produce data representing a beat pattern for the piece of digital music;

calculating, by the computer processor, an irregular pattern score based on a difference between the beat pattern data and the self-similarity matrix data, wherein the irregular pattern score represents a presence of dense ornamentation in the piece of music; and causing, by the computer processor, a change in a multimedia playback based on the calculated irregular pattern score.

2. The method of claim 1, wherein the calculating of the onset detection array includes calculating, for each of the column vectors in the spectrogram, a sum of the time-frequency coefficients in the respective column vector, and wherein the sums are the elements in the onset detection array.

3. The method of claim 1, wherein the pair-wise comparisons of elements in the onset detection array comprises calculating a distance between different elements in the onset detection array.

4. The method of claim 1, further comprising separating, by the computer processor, non-percussive sources in the piece of music from percussive sources in the piece of music by modifying at least one of the time-frequency coefficients in the spectrogram.

5. The method of claim 4, wherein the separating occurs prior to the calculating of the one-dimensional onset detection array.

6. The method of claim 1, further comprising weighting, by the computer processor, the irregular pattern score based on the time-frequency coefficients in the spectrogram to produce a weighted irregular pattern score.

7. The method of claim 1, wherein a number of columns of the self-similarity matrix is less than a number of rows of the self-similarity matrix.

8. In a digital medium environment for processing digital audio, a system for detection of dense ornamentation in music, the system comprising:

a storage; and a computer processor operatively coupled to the storage, the computer processor configured to execute instructions stored in the storage that when executed cause the computer processor to carry out a process comprising:

receiving input data representing a piece of digitally encoded music in a time domain;

converting the input data into a spectrogram representing a two-dimensional matrix of time-frequency coefficients in a frequency domain, the spectrogram including a plurality of column vectors of the time-frequency coefficients that correspond to a plurality of time periods spanning different portions of the piece of music;

calculating a one-dimensional onset detection array based on a subset of the column vectors in the spectrogram, wherein the subset of the column vectors in the spectrogram is fewer than all of the column vectors in the spectrogram;

generating data representing a two-dimensional self-similarity matrix based on pair-wise comparisons of elements in the onset detection array, the self-similarity matrix comprising a plurality of columns;

applying a median filter to the self-similarity matrix to produce data representing a beat pattern for the piece of digital music;

calculating an irregular pattern score based on a magnitude difference between the beat pattern data and each column of the self-similarity matrix, wherein the irregular pattern score represents a presence of dense ornamentation in the piece of music; and causing synchronization of a visual presentation with playback of the piece of music, wherein the irregular pattern score representing the presence of dense ornamentation causes a change in the visual presentation.

9. The system of claim 8, wherein the calculating of the onset detection array includes calculating, for each of the column vectors in the spectrogram, a sum of the time-frequency coefficients in the respective column vector, and wherein the sums are the elements in the onset detection array.

10. The system of claim 8, wherein the pair-wise comparisons of elements in the onset detection array comprises calculating a distance between different elements in the onset detection array.

11. The system of claim 8, wherein the process further comprises separating non-percussive sources in the piece of music from percussive sources in the piece of music by modifying at least one of the time-frequency coefficients in the spectrogram.

12. The system of claim 11, wherein the separating occurs prior to the calculating of the one-dimensional onset detection array.

13. The system of claim 8, wherein the process further comprises weighting the irregular pattern score based on the time-frequency coefficients in the spectrogram to produce a weighted irregular pattern score.

14. The system of claim 8, wherein a number of columns of the self-similarity matrix is less than a number of rows of the self-similarity matrix.

15. A non-transitory computer program product having instructions encoded thereon that when executed by one or more computer processors cause the one or more computer processors to perform a process comprising:

receiving input data representing a piece of digitally encoded music in a time domain;

converting the input data into a spectrogram representing a two-dimensional matrix of time-frequency coefficients in a frequency domain, the spectrogram including a plurality of column vectors of the time-frequency coefficients that correspond to a plurality of time periods spanning different portions of the piece of music;

calculating a one-dimensional onset detection array based on at least one of the column vectors in the spectrogram;

generating data representing a two-dimensional self-similarity matrix based on pair-wise comparisons of elements in the onset detection array;

applying a median filter to the self-similarity matrix to produce data representing a beat pattern for the piece of digital music; and calculating an irregular pattern score based on a difference between the beat pattern data and the self-similarity matrix data, wherein the irregular pattern score represents a presence of dense ornamentation in the piece of music.

16. The non-transitory computer program product of claim 15, wherein the calculating of the onset detection array includes calculating, for each of the column vectors in the spectrogram, a sum of the time-frequency coefficients in the respective column vector, and wherein the sums are the elements in the onset detection array.

17. The non-transitory computer program product of claim 15, wherein the pair-wise comparisons of elements in the onset detection array comprises calculating a distance between different elements in the onset detection array.

18. The non-transitory computer program product of claim 15, wherein the process further comprises separating non-percussive sources in the piece of music from percussive sources in the piece of music by modifying at least one of the time-frequency coefficients in the spectrogram.

19. The non-transitory computer program product of claim 18, wherein the separating occurs prior to the calculating of the one-dimensional onset detection array.

20. The non-transitory computer program product of claim 15, wherein the process further comprises weighting the irregular pattern score based on the time-frequency coefficients in the spectrogram to produce a weighted irregular pattern score.

* * * * *